US005839253A

United States Patent [19]

Draghetti

[11] Patent Number: 5,839,253

[45] Date of Patent: Nov. 24, 1998

[54] PRODUCT OVERWRAPPING MACHINE

[75] Inventor: Fiorenzo Draghetti, Medicina, Italy

[73] Assignee: G.D Societa' per Azioni, Bologna, Italy

[21] Appl. No.: 816,637

[22] Filed: Mar. 13, 1997

[30] Foreign Application Priority Data

Mar. 15, 1996 [IT] Italy ..... BO96A0140

[51] Int. Cl.[6] ..... B65B 19/22

[52] U.S. Cl. ..... 53/234; 53/375.9; 53/376.2; 53/387.3

[58] Field of Search ..... 53/234, 233, 228, 53/230, 387.3, 387.2, 375.9, 376.2, 466, 463

[56] References Cited

U.S. PATENT DOCUMENTS

| | | | |
|---|---|---|---|
| 3,527,014 | 9/1970 | Wahle et al. | 53/466 X |
| 4,866,912 | 9/1989 | Deutsch | 53/466 X |
| 5,477,661 | 12/1995 | Draghetti et al. | 53/234 X |
| 5,544,467 | 8/1996 | Focke | 53/387.2 |

FOREIGN PATENT DOCUMENTS

| | | |
|---|---|---|
| 0555852 | 8/1993 | European Pat. Off. . |
| 1078930 | 3/1960 | Germany . |
| 856905 | 12/1960 | United Kingdom . |

*Primary Examiner*—James F. Coan
*Attorney, Agent, or Firm*—Ladas & Parry

[57] ABSTRACT

A machine for overwrapping products in sheets of wrapping material, whereby a product, traveling continuously along a path while maintaining a lateral surface perpendicular at all times to a traveling direction, is wrapped in a respective sheet, which forms a tubular wrapping about the product; the machine having a movable gripping device, which is maintained in a gripping position contacting end surfaces of the product parallel to the traveling direction, to feed the product along the path for at least the time taken to stabilize the tubular wrapping.

14 Claims, 9 Drawing Sheets

26
60
54
16
P1
21
61
58
59
30
101
55
56
12
28
48
45
44
43
57
17
2
74
18

PRODUCT OVERWRAPPING MACHINE

BACKGROUND OF THE INVENTION

The present invention relates to a product overwrapping machine.

The present invention is particularly advantageous in the field of continuous overwrapping machines, such as continuous cellophaning machines for tobacco products such as packets or cartons of cigarettes, to which the following description refers purely by way of example.

Though specific reference is made in the following description to the use of sheets of thermoplastic or heat-seal wrapping material, use may of course be made of sheets of different material, the end portions of which may be gummed or otherwise stabilized in the folded position by operations equivalent to heat-seal stabilization.

GB Patent 1,134,500 relates to a continuous cellophaning machine for packets of cigarettes, in which the packets are overwrapped in sheets of thermoplastic material as they are fed along a given path. Along successive portions of the path, the packets are subjected to: a first wrapping operation wherein each sheet is folded into a U about a respective packet; a second wrapping operation wherein each sheet is further folded to form about the respective packet a tubular wrapping open at both ends; a first stabilizing operation wherein each tubular wrapping is closed by heat-sealing it longitudinally; a third wrapping operation wherein the open ends of each tubular wrapping are folded on to the respective packet; and a final stabilizing operation wherein the folded ends of each tubular wrapping are fixed by heat-sealing the ends.

On known continuous cellophaning machines, the first of the above stabilizing operations is normally performed by pressing two superimposed end portions of the sheet of wrapping material against each other and the product using a heat-sealing device or similar tool to close the tubular wrapping longitudinally. Since, when doing so, however, the axial ends of the tubular wrapping are not supported internally, the join often presents defects at the ends, which create serious problems when it comes to performing the third of the above wrapping operations.

SUMMARY OF THE INVENTION

It is an object of the present invention to provide an overwrapping machine designed to overcome the aforementioned drawback.

According to the present invention, there is provided a machine for overwrapping products in sheets of wrapping material, the machine comprising conveying means for feeding a product continuously in a given traveling direction and along a given path, while maintaining a lateral surface of the product perpendicular at all times to said traveling direction; supply means for feeding a sheet of wrapping material through said path at an intercepting station where the sheet is intercepted by the product; first wrapping means for engaging the sheet and folding the sheet into a U about the product; second wrapping means movable to and from an engaged position engaging the sheet and for further folding the sheet about the product to form a tubular wrapping with opposite open ends; first stabilizing means movable to and from an operating position to close the tubular wrapping by means of a longitudinal joint; third wrapping means for folding said open ends on to the product; and second stabilizing means for fixing said folded ends by means of an end joint; the machine being characterized in that said conveying means comprise a gripping device movable with the conveying means along said path, and also movable, in relation to the conveying means, to and from a gripping position contacting, in use, end surfaces of the product parallel to said traveling direction; and control means for maintaining the gripping device in the gripping position for at least one interval of time in which said first stabilizing means are in the operating position.

By means of the above gripping device, the above machine therefore provides for penetrating the open ends of the tubular wrapping to define supporting surfaces enabling the formation of a perfect joint, even at the portions of the tubular wrapping projecting beyond the product.

On the continuous cellophaning machine described in GB Patent 1,134,500, as well as on other similar known machines, the second of the above wrapping operations, i.e. to close the tubular wrapping laterally, is performed by transferring the packets and respective sheets from one conveyor wheel to another.

Over and above an output rate of 600–700 packets/minute of the cellophaning machine, transferring the packets and sheets from one conveyor to another creates serious drawbacks resulting in unacceptably defective overwrappings, especially when working with very thin sheets of about 10–15 micron. Such drawbacks are mainly due to the above known machine failing to keep the packet under control throughout formation of the tubular wrapping.

To overcome the above drawback, in a preferred embodiment of the machine according to the present invention, said control means are so formed as to maintain the gripping device in the gripping position to feed the product along said path for at least a further interval of time in which said second wrapping means are in said engaged position, and preferably along a portion of the path extending at least from said intercepting station.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
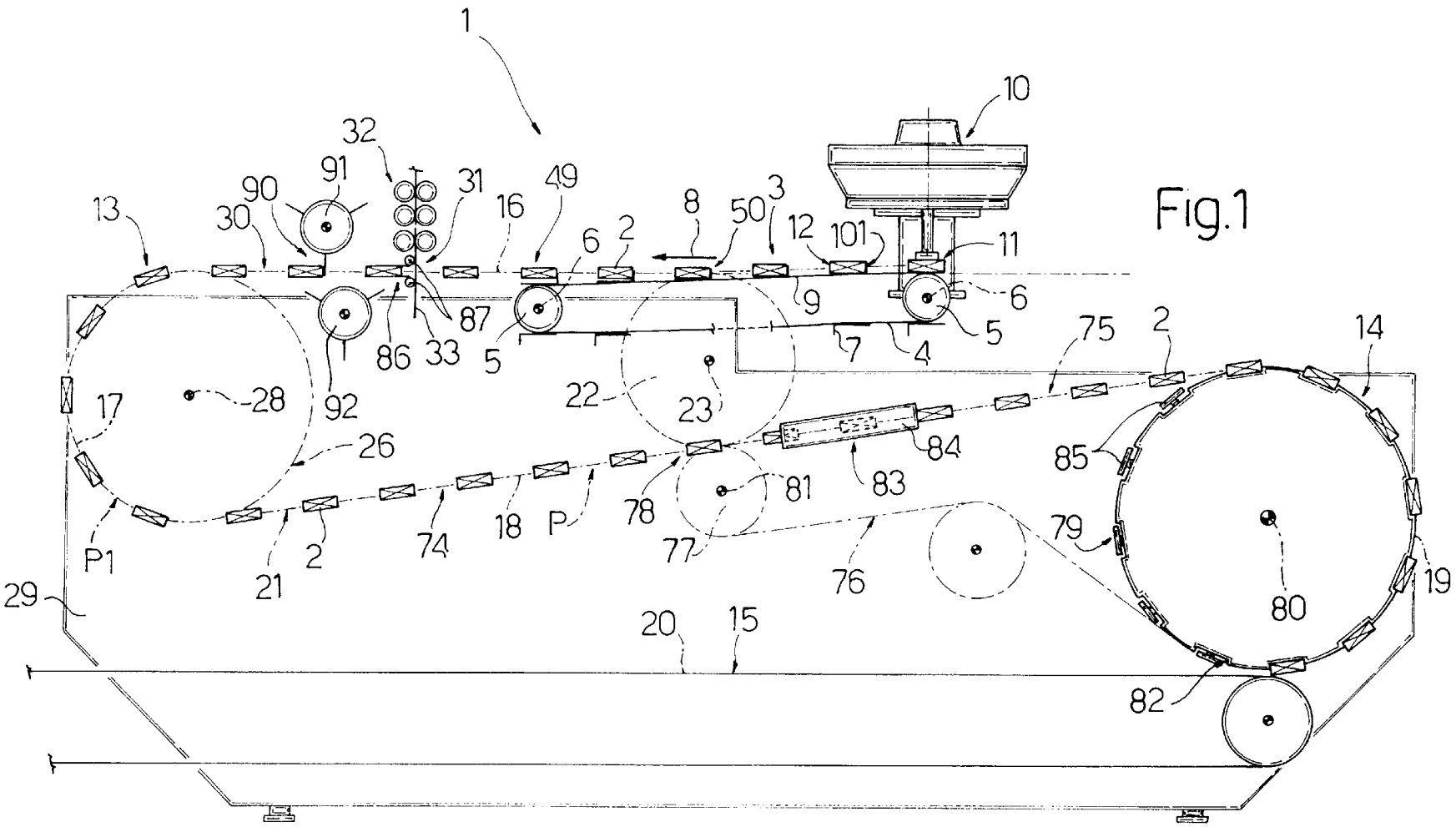
FIG. 1 shows a schematic side view, with parts removed for clarity, of a continuous cellophaning machine in accordance with the present invention.
Figure 2:
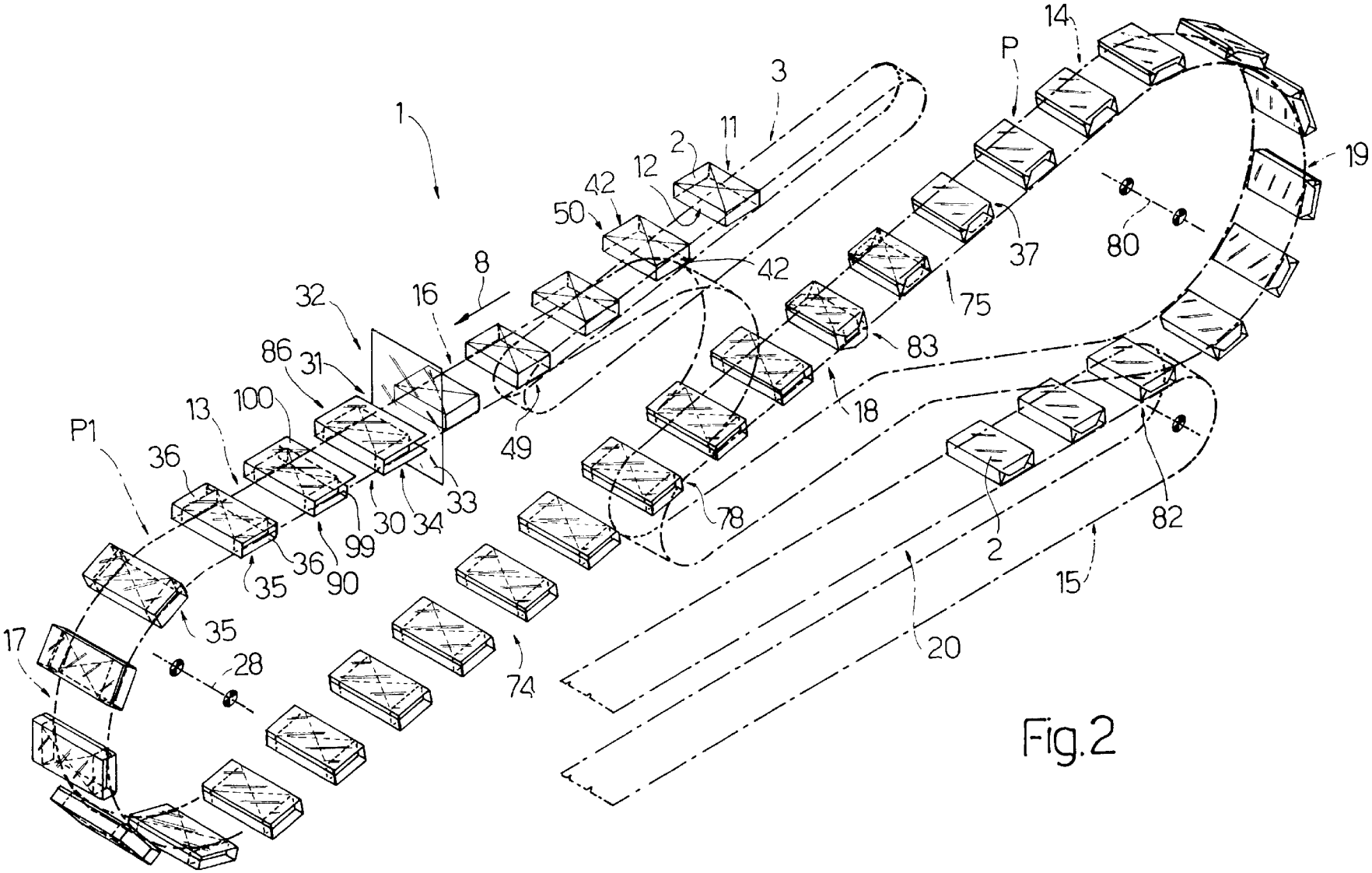
FIG. 2 shows a schematic view in perspective of the succession of operations performed on the FIG. 1 machine.
Figure 3:
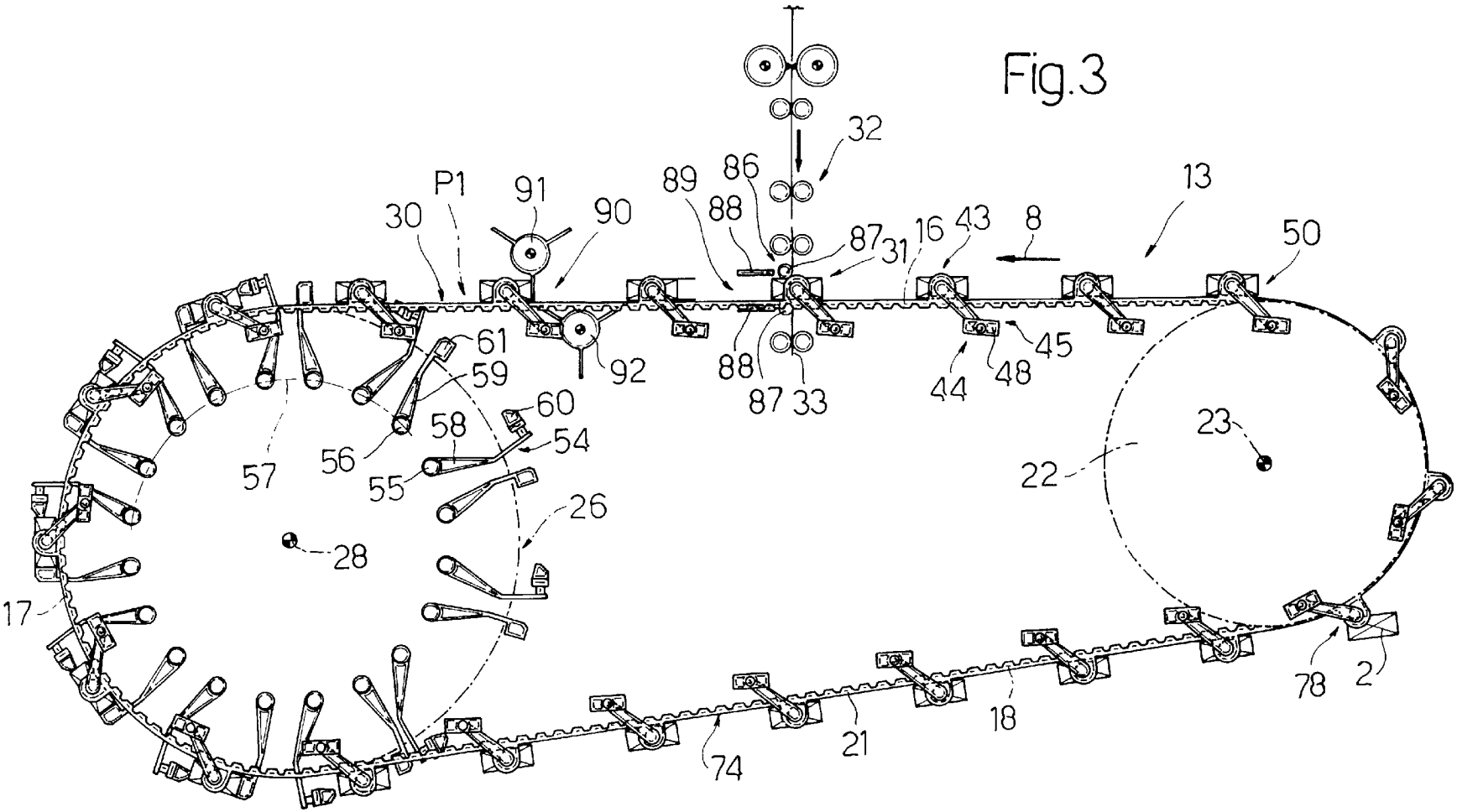
FIG. 3 shows a larger-scale schematic side view of a first detail in FIG. 1.

Number 1 in FIG. 1 indicates a continuous cellophaning machine for packets 2 of cigarettes. Machine 1 comprises an input conveyor 3 defined by a belt 4 looped about two pulleys 5—one of which is a drive pulley—mounted for rotation about respective parallel, substantially horizontal axes 6. Belt 4 comprises a number of transverse projections 7 parallel to axes 6 and defining, with adjacent projections 7, a number of transportation pockets, each of which—measured in the traveling direction 8 of the upper transportation branch 9 of belt 4—is of a length greater than the width of packets 2, and of a width substantially equal to the length of packets 2. At a loading station 11, each pocket of transportation branch 9 of belt 4 is supplied by a rotary turret conveyor 10 with a respective packet 2 laid flat with a small longitudinal lateral surface 12 facing forward in direction 8 and substantially perpendicular to direction 8.

Machine 1 also comprises a first wrapping conveyor 13, a second wrapping conveyor 14, and an output conveyor 15, which are arranged in series and connected to one another to define, with input conveyor 3, a substantially S-shaped path P along which packets 2 are fed. More specifically, as of station 11, path P comprises, in series, a first substantially straight portion 16 defined by conveyor 3 and by an input portion of conveyor 13; a first curved portion 17 defined by a curved portion of conveyor 13; a second straight portion 18 facing portion 16 to define, with portions 16 and 17, a substantially U-shaped path P1, and comprising an output portion of conveyor 13 and an input portion of conveyor 14; a second curved portion 19 defined by a curved portion of conveyor 14; and a third straight portion 20 defined by output conveyor 15 and facing portions 16 and 18.

Figure 8:
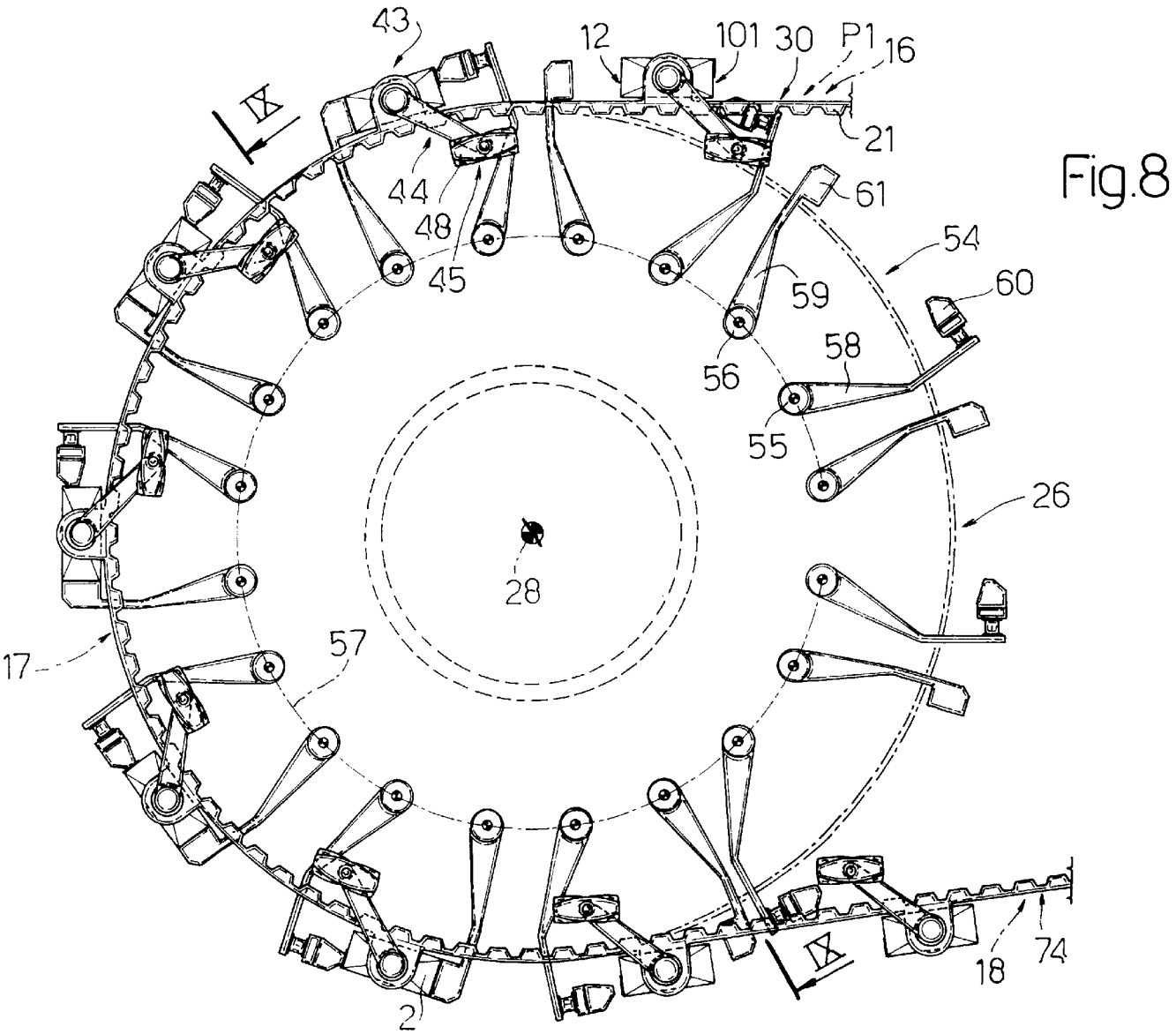
FIG. 8 shows a larger-scale view of a further detail in FIG. 3.
Figure 9:
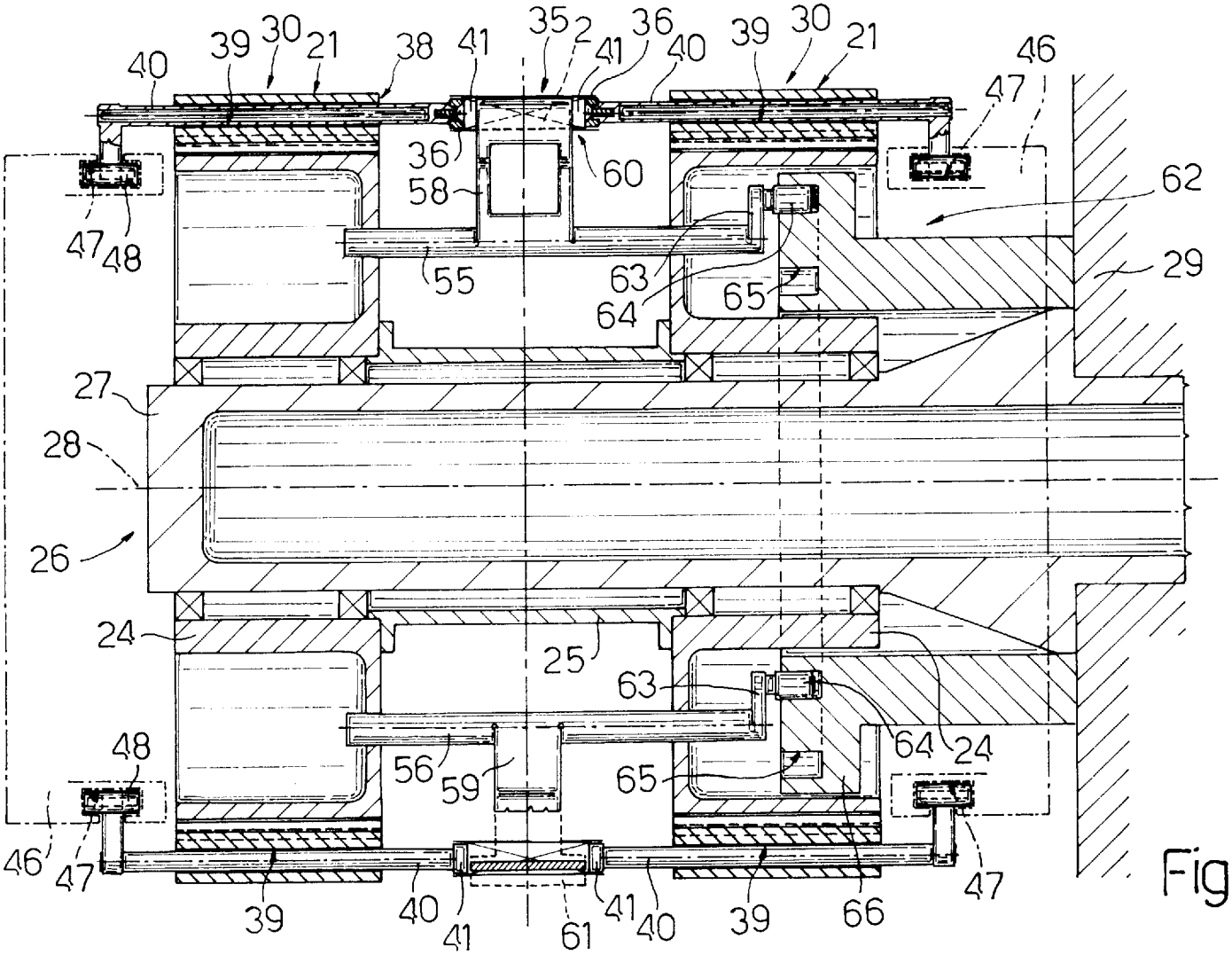
FIG. 9 shows a section along line IX—IX in FIG. 8.

As shown more clearly in FIGS. 3, 6, 8 and 9, conveyor 13 comprises two parallel, internally toothed belts 21, each looped about a respective pair of toothed pulleys. More specifically, each belt 21 is fitted to a respective powered input pulley 22—which is integral with pulley 22 of the other belt 21 and mounted for rotation about an axis 23 parallel to axes 6—and to a respective disk 24, which, as shown particularly in FIG. 9, is connected integrally to the other disk 24 by a central sleeve 25 to define a cylindrical drum 26. Drum 26 defines, with the portion of its outer periphery contacting belts 21, the curved portion 17 of paths P and P1, and is fitted idly to a shaft 27 having an axis 28 parallel to axis 23 and fitted, together with pulleys 22 and 5, to a fixed frame 29.

Each belt 21 comprises a substantially straight upper branch 30 defining an output portion of straight portion 16 of paths P and P1, and extending, at a loading or intercepting station 31, through a known line 32 for supplying a succession of sheets 33 of wrapping material, each of which is folded about a respective packet 2 to form firstly a U-shaped wrapping 34, and subsequently a tubular wrapping 35, the opposite axial ends 36 of which project beyond the corresponding ends of packet 2, and are subsequently folded to form a closed wrapping 37. At station 31, each sheet 33 lies in a plane perpendicular to that of belts 21, which are separated from each other by such a distance as to define a channel 38 wider than sheets 33.

Figure 6:
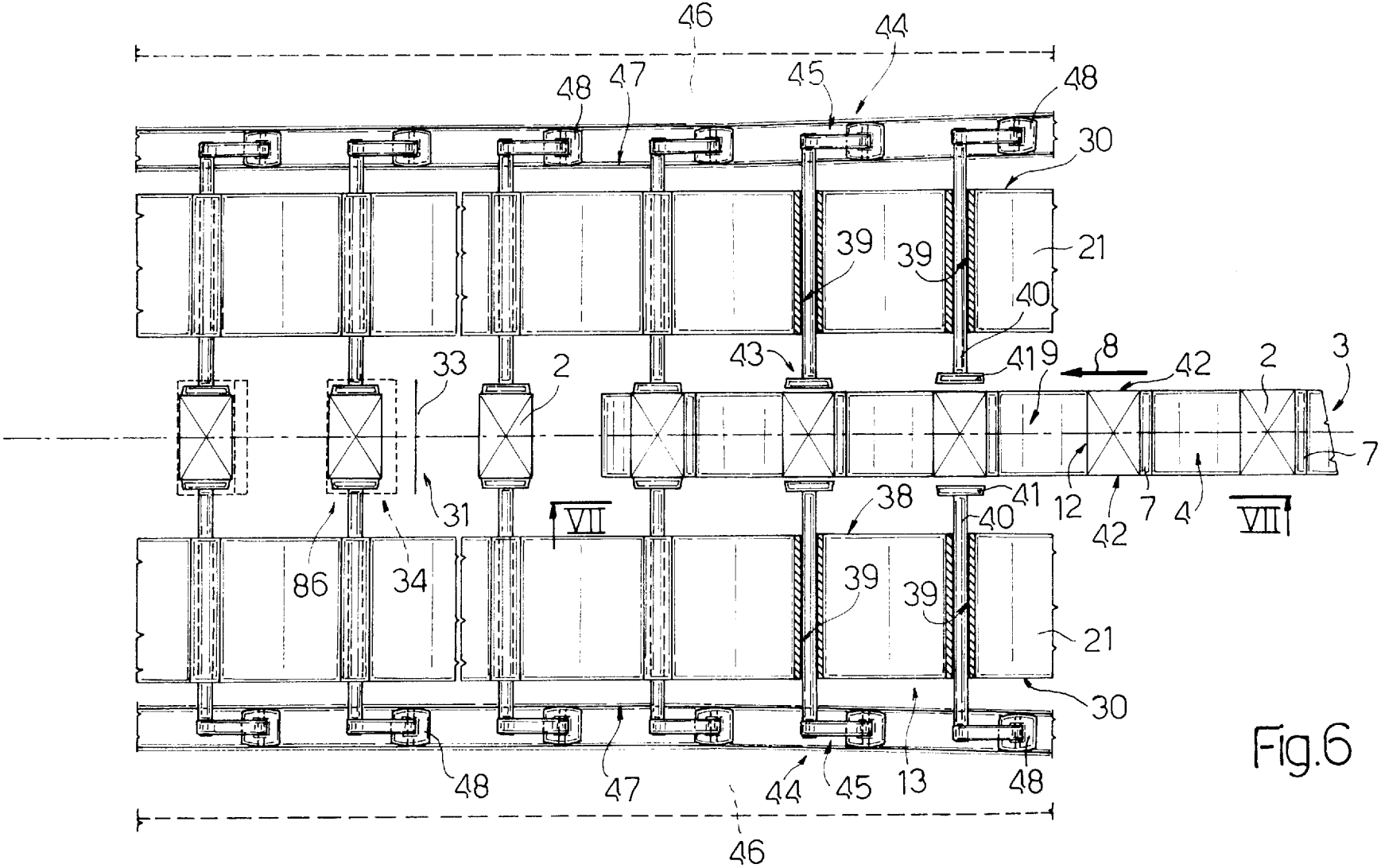
FIG. 6 shows a larger-scale schematic plan view of a second detail in FIG. 1.

As shown more clearly in FIG. 6, each belt 21 comprises a number of through holes 39 formed in the thickness of belt 21, parallel to axes 6, and spaced along belt 21 with the same spacing as projections 7. Each hole 39 houses an axially-sliding rod 40 coaxial with a corresponding rod 40 on the other belt 21, and fitted, on the free end inside channel 38, with a pad 41, the transverse dimensions of which are approximately equal to but no greater than the dimensions of two axial end surfaces 42 of packet 2 extending parallel to direction 8.

Each pair of corresponding rods 40 and respective pads 41 define a gripping device 43 of a gripping assembly 44, and the axial position of rods 40 and pads 41 in relation to respective belt 21 is governed by control means comprising a cam actuating device 45 forming part of assembly 44 and which comprises, for each belt 21, a plate 46 perpendicular to axes 23 and 28 and of the same shape as belt 21. Each plate 46 is located on the opposite side of respective belt 21 in relation to the other belt 21, and comprises a respective peripheral track 47, which is engaged by a number of slides 48, each connected to the end of a respective rod 40 opposite the end fitted with respective pad 41, and curves in a direction crosswise to direction 8 to move pads 41 to and from a gripping position in which pads 41 of each device 43 are separated by a minimum distance approximately equal to but no greater than the length of packets 2 measured perpendicularly to surfaces 42.

Figure 7:
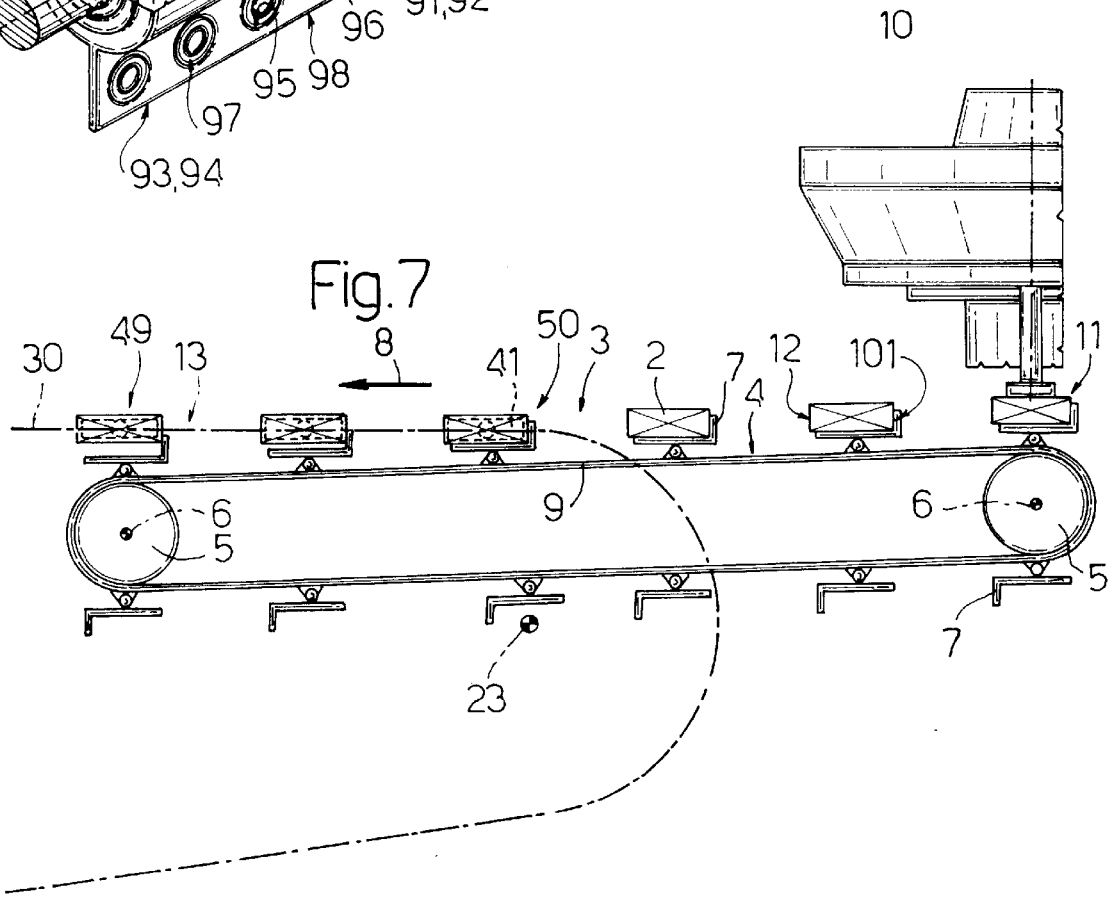
FIG. 7 shows a section along line VII—VII in FIG. 6.

With reference to FIGS. 1, 6 and 7, input conveyor 3 comprises an output portion extending along channel 38 between belts 21 and (FIG. 7) sloping downwards in relation to branch 30 of each belt 21, while projections 7 are positioned perpendicular to the surface of branches 30. The downward slope of conveyor 3 is such that packets 2, when resting on the surface of branches 30, are detached from projections 7 at a transfer station 49 located downstream in direction 8 from a gripping station 50 where pads 41 of each device 43 reach the gripping position.

Figure 10:
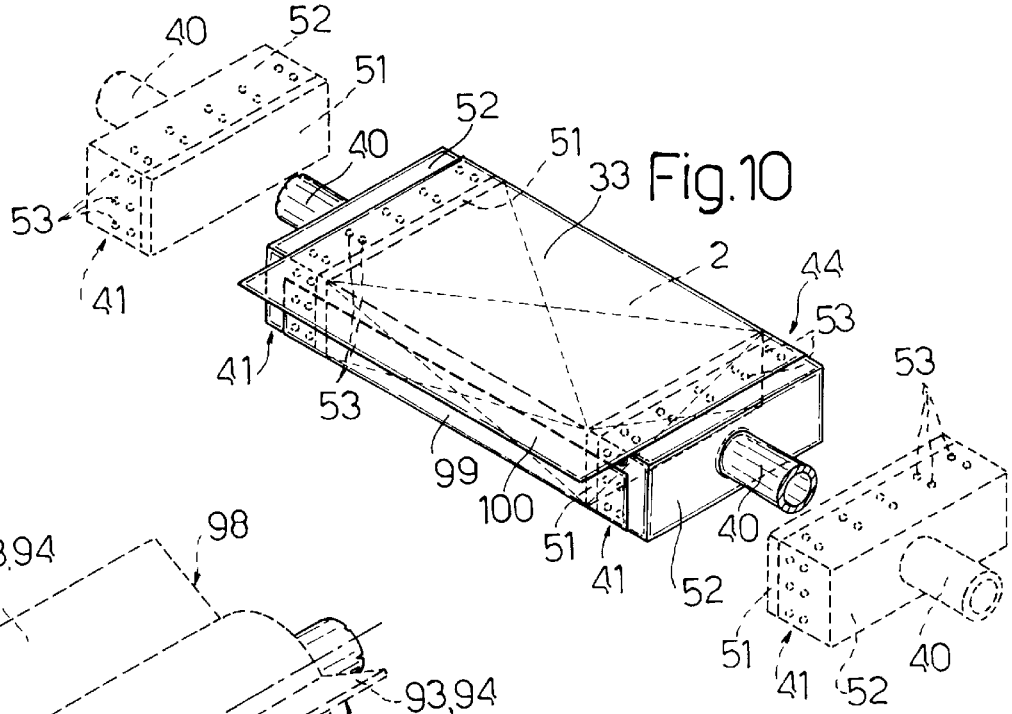
FIG. 10 shows a larger-scale view in perspective of a variation of a detail in FIG. 6.

To prevent damaging packets 2, each pad 41 comprises a deformable end element 51, which may be fitted directly to the free end of respective rod 40, or, as shown in the FIG. 10 variation, is connected to a hollow body 52 interposed between rod 40 and element 51 and having external suction holes 53.

As shown particularly in FIG. 8, each device 43 is associated, on drum 26, with a respective heat-seal device 54 comprising two shafts 55 and 56 parallel to axis 28 and mounted for rotation between disks 24 and preferably, but not necessarily, along a circumference 57. Shafts 55 and 56 are fitted with respective radial arms 58 and 59 located between disks 24 and projecting outwards of belts 21. At the arc traveled by pads 41 about axis 28, arm 58 is fitted with a heat-sealer 60 facing in the traveling direction 8 of packets 2, and arm 59 is fitted with a pad 61 facing respective heat-sealer 60. Shafts 55 and 56 of each device 54 are rotated in opposite directions by an actuating device 62 (FIG. 9) comprising two square levers 63, which are connected to the ends of shafts 55 and 56 facing frame 29, and comprise respective tappet rollers 64 engaging in rolling manner respective tracks 65 formed on the face of an annular cam 66 fitted in a fixed position to frame 29.

Figure 11:
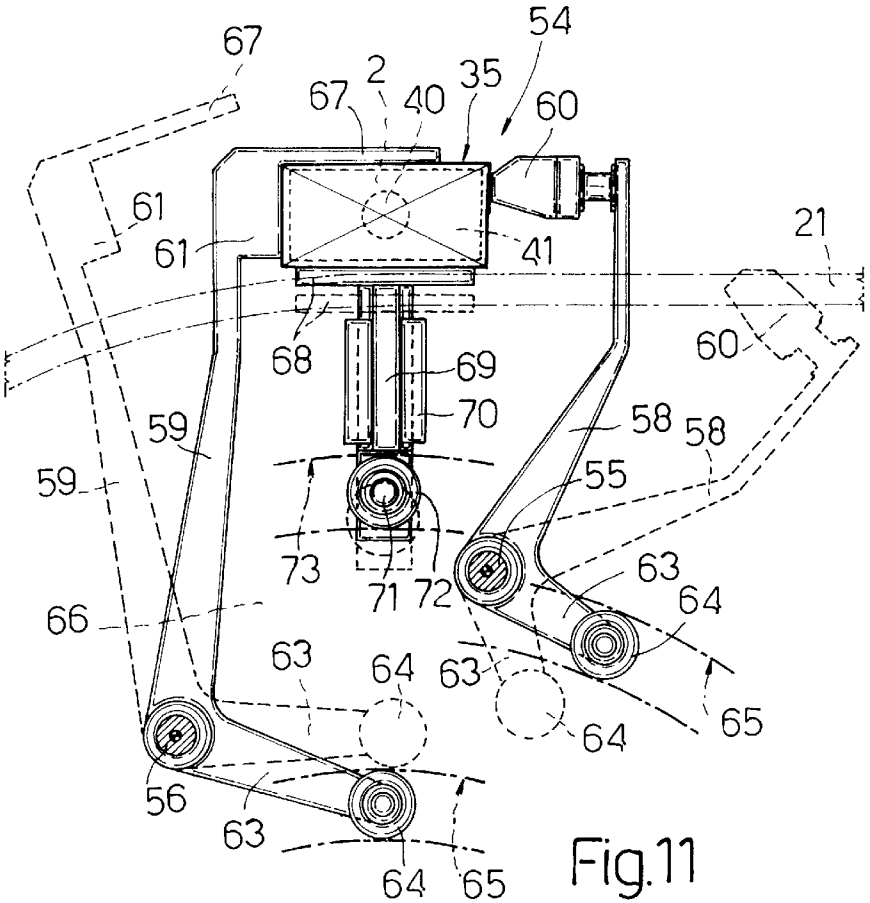
FIG. 11 shows a larger-scale schematic side view of a variation of a first detail in FIG. 8.

In the FIG. 11 variation, each pad 61 comprises a tooth 67 extending parallel to the outer periphery of drum 26, towards respective heat-sealer 60, and located just outwards of the arc traveled by pads 41 about axis 28. Again according to the FIG. 11 variation, each tooth 67 is located radially outwards of a radial push pad 68 mounted between disks 24 and connected integrally to one end of a radial rod 69. Rod 69 is fitted in sliding manner inside a radial guide 70 fitted to disks 24, and comprises, on the opposite end to that fitted with pad 68, a transverse pin 71 supporting for rotation a tappet roller 72 engaging in rolling manner a respective track 73 of cam 66.

As shown in FIG. 1, each belt 21 comprises a lower branch 74 facing branch 30 and coaxial with an upper branch 75 of a belt 76 of conveyor 14. Belt 76 comprises projections similar to belt 4, and is looped about a pulley 77 located between belts 21 at a transfer station 78, and about a powered heat-sealing drum 79 rotating about an axis 80 parallel to the rotation axis 81 of pulley 77 and to axis 6. Branches 74 and 75 define the straight portion 18 of paths P and P1, and the periphery of drum 79 defines curved portion 19 of path P and is tangent to output conveyor 15 at a transfer station 82.

Branch 75 extends through a folding station 83 defined by a known folding device 84 for folding ends 36 of wrappings 35 to form respective wrappings 37; and drum 79 is fitted with pairs of known end heat-sealers 85 for stabilizing the folded ends 36 of wrappings 37.

No further description is given here of conveyor 14, which forms the object of U.S. Pat. No. 5,477,661, to which full reference is made herein in the interest of disclosure.

Figure 4:
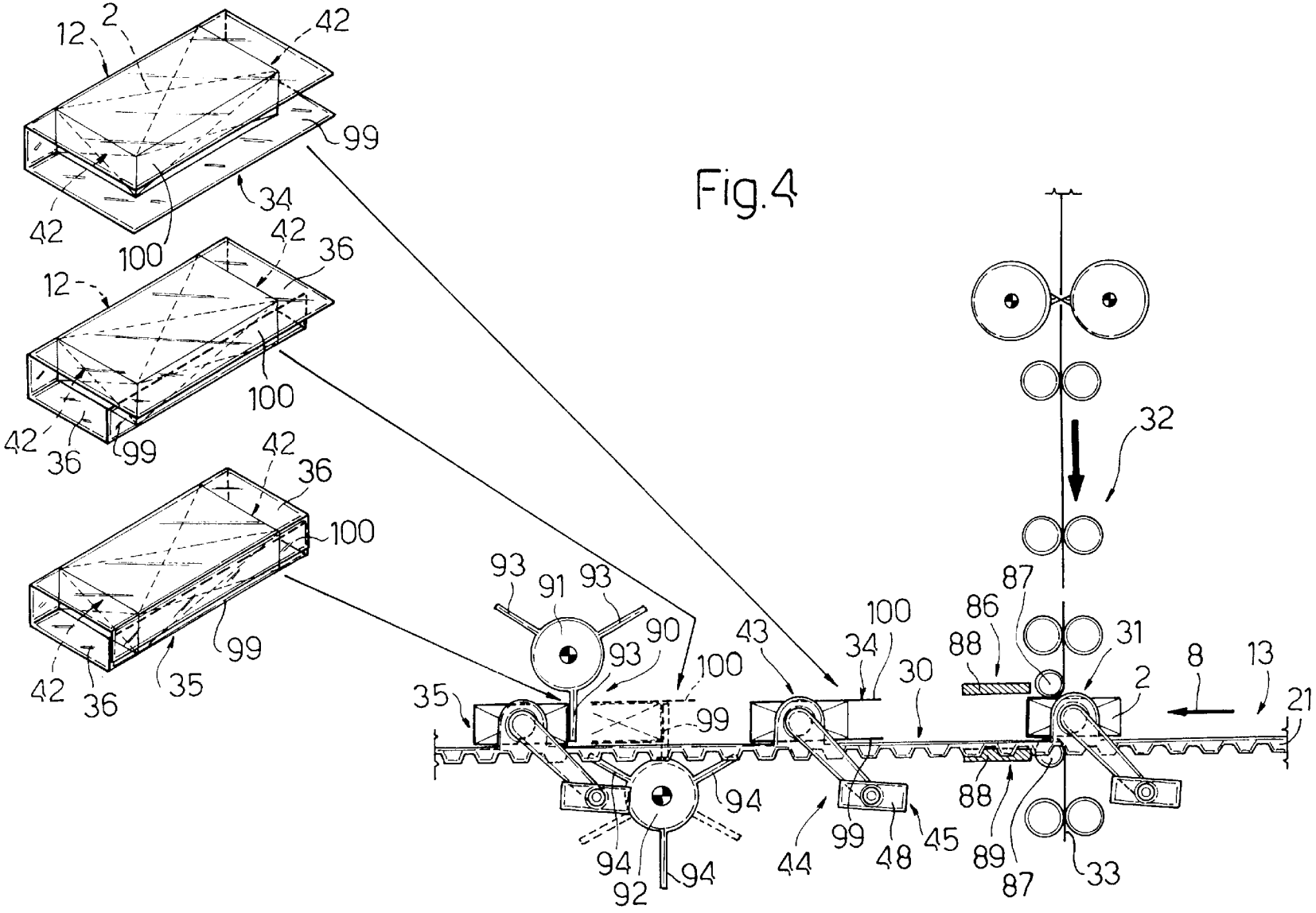
FIG. 4 shows a larger-scale view of a first detail in FIG. 3.

As shown particularly in FIG. 4, branch 30 of each belt 21 extends through a folding station 86 located immediately downstream from loading station 31 in direction 8 and defined by two rollers 87 fitted one over the other to frame 29 and parallel to axis 6. Rollers 87 define a passage located along path P and of a width approximately equal to but no smaller than the thickness of packet 2 measured perpendicularly to branch 30 and direction 8. Station 86 also comprises two plates 88 forming the plates of a capacitor 89, and which are located immediately downstream from rollers 87 in direction 8, and respectively over and beneath path P to define, with rollers 87, a channel for the passage of packets 2.

As shown particularly in FIG. 4, branch 30 of each belt 21 extends through a further folding station 90 located along straight portion 16 of paths P and P1, downstream from station 86 in direction 8, and defined by two rollers 91 and 92 fitted one over the other to frame 29 and parallel to axis 6. Rollers 91 and 92 comprise respective radial appendixes 93 and 94 extending longitudinally along the outer periphery of rollers 91 and 92, and defining respective movable folding elements for intersecting paths P and P1 and folding each sheet 33 on to the surface of respective packet 2 opposite surface 12.

Figure 5:
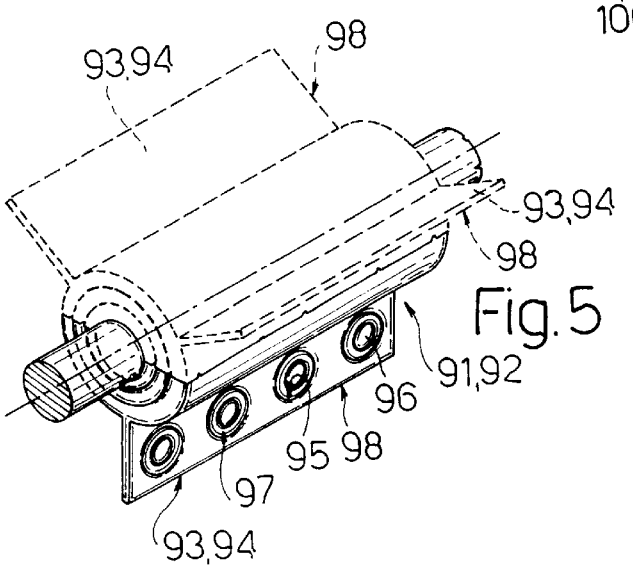
FIG. 5 shows a larger-scale view in perspective of a second detail in FIG. 3.

As shown in FIG. 5, each appendix 93, 94 is made of metal, and comprises circular holes 95, which, via the interposition of respective annular insulating elements 97, house respective metal inserts 96, each of which defines, with relative appendix 93, 94, the plates of a multiple capacitor 98.

The operations performed by machine 1 on each packet 2 will now be described as of when conveyor 10 releases packet 2 in contact with a respective projection 7 of conveyor 3 at loading station 11.

Traveling at constant speed along branch 9 of conveyor 3 in direction 8, packet 2 enters channel 38 defined by belts 21 of conveyor 13, and is gradually lowered until it is gripped by respective gripping device 43, the pads 41 of which close on to respective surfaces 42 of packet 2. For a given distance downstream from station 50 and up to station 49, packet 2 is conveyed simultaneously by conveyors 3 and 13 traveling at the same speed in direction 8, and is subsequently left connected, by means of respective gripping device 43, to conveyor 13 only, by which it is fed at constant speed through folding station 86.

At station 86, the packet intercepts a respective sheet 33 supplied by line 32, and inserts it through the passage defined by the two rollers 87 and two plates 88 of capacitor 89, so that sheet 33 is folded to form U-shaped wrapping 34 about packet 2. More specifically, sheet 33 is arranged with a central portion contacting surface 12 of packet 2, with two end portions contacting the top and bottom surfaces of packet 2, and with two end portions 99 and 100 projecting rearwards from the lateral surface 101 of packet 2 opposite surface 12.

The passage of sheet 33 between plates 88 of capacitor 89 induces electric charges on sheet 33, and corresponding electric charges of opposite sign on the surfaces of packet 2, the outer wrapping of which is made of dielectric material. The sheet therefore adheres firmly to packet 2 in the U-folded configuration by electrostatic attraction, and may safely be supplied to folding station 90 where portions 99 and 100 are folded by folding rollers 91 and 92, the first on to surface 101, and the second on to surface 101 and partially on to portion 99. This further folding operation is performed as packet 2 travels along straight portion 16 of paths P and P1, thus ensuring highly precise folds, and provides for folding sheet 33 completely about packet 2 to form tubular wrapping 35, which is thus formed without gripping device 43 ever having to release packet 2.

When folding portions 99 and 100 also, perfect adherence of portions 99 and 100 to packet 2 and to each other is ensured by electric charges induced on portions 99 and 100 and surface 101 by capacitors 98 on appendixes 93 and 94 of rollers 91 and 92. As such, the electric charges induced by capacitors 89 and 98 ensure sheet 33 adheres perfectly to packet 2 throughout the formation of tubular wrapping 35. If appendixes 93 and 94 are straightforward folding devices, the position of sheet 33 on packet 2 when forming tubular wrapping 35 may be controlled using pads 41 of the type shown in FIG. 10.

As it travels along curved portion 17 of paths P and P1, wrapping 35 is stabilized by connecting portions 99 and 100 by means of a longitudinal heat seal made by gripping packet 2 between respective heat-sealer 60 and respective pad 61, which provides for counterbalancing the pressure exerted by heat-sealer 60 when heat-sealing portions 99 and 100.

Wrapping 35 is preferably stabilized using the heat-seal device 54 in FIG. 11, wherein tooth 67 of pad 61 and pad 68 prevent the top and bottom walls of packet 2 from bending outwards under the transverse pressure exerted by heat-sealer 60 and pad 61.

When stabilizing wrapping 35, the pads 41 inside respective ends 36 of wrapping 35 provide for supporting sheet 33 during operation of heat-sealer 60, thus enabling the formation of a perfect heat seal extending not only along the central portion of wrapping 35 occupied by packet 2, but also along ends 36 projecting beyond the ends of packet 2.

Once enclosed in wrapping 35, packet 2 is supplied to station 83, where ends 36 are folded in known manner to form closed wrapping 37, which is stabilized by heat-sealers 85 as packet 2 travels along curved portion 19 of path P.

Figure 12:
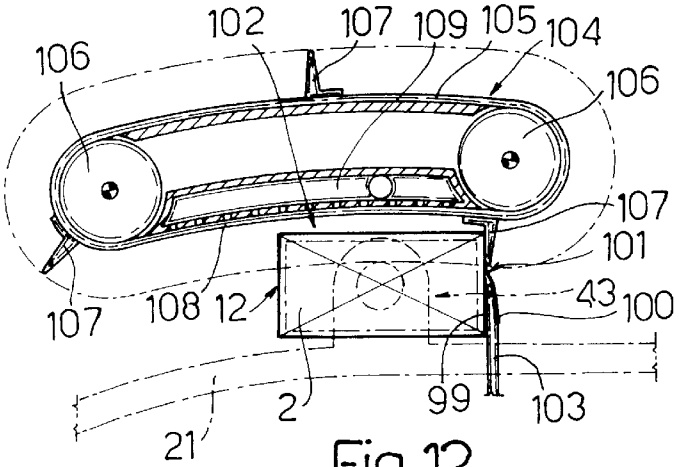
FIGS. 12 and 13 show larger-scale schematic side views of a variation of a second detail in FIG. 8.
Figure 13:
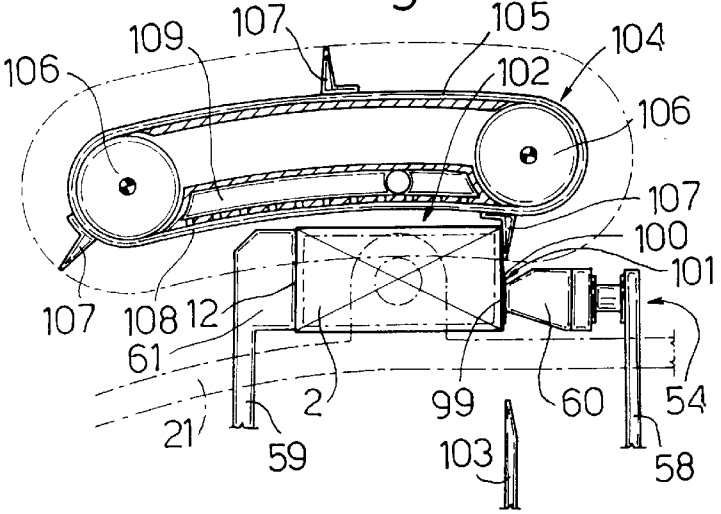

In the variation shown in FIGS. 12 and 13, folding station 90 and rollers 91 and 92 of FIG. 1 are replaced by a folding station 102 along curved portion 17 of paths P and P1. At station 102, inner portion 99 of each wrapping 34 is folded on to surface 101 of packet 2 by means of a known folding device 103 fitted to drum 26 at a respective heat-sealing device 54 and movable, in relation to drum 26 and by a known actuating device preferably activated by cam 66 via a further track (not shown), to and from a forward position in which folding device 103 interferes with path P1 to press portion 99 on to surface 101 of packet 2. As shown in FIG. 12, portion 100, on the other hand, is folded on to surface 101 by a folding device 104 comprising a belt 105 looped about two pulleys 106—one of which is powered—and traveling at the same speed as belts 21. Belt 105 is fitted with folding elements 107, and comprises a branch 108 extending outside drum 26, traveling in the same direction as belts 21, and maintained parallel to belts 21 by a suction device 109 to feed a folding element 107 through station 102 in time with a respective packet 2 and in such a position as to engage and fold portion 100 of wrapping 34 on to surface 101 of packet 2 and partially on to portion 99.

In actual use, portion 99 is first folded on to surface 101 by folding device 103. Folding element 107 then folds portion 100 squarely on to surface 101 and partially over folding device 103, which at this point is withdrawn to release portion 99 and permit heat-sealer 60 to operate on the superimposed portion of portions 99 and 100.

I claim:

1. A machine for overwrapping products (2) in sheets (33) of wrapping material, the machine (1) comprising conveying means (3, 13, 14, 15) for feeding a product (2) continuously in a given traveling direction (8) and along a given path (P), while maintaining a lateral surface (12) of the product (2) perpendicular at all times to said traveling direction (8); supply means (32) for feeding a sheet (33) of wrapping material through said path (P) at an intercepting station (31) where the sheet (33) is intercepted by the product (2); first wrapping means (87, 89) for engaging the sheet (33) and folding the sheet (33) into a U about the product (2); second wrapping means (91, 92; 103, 104) movable to and from an engaged position engaging the sheet (33) and for further folding the sheet (33) about the product (2) to form a tubular wrapping (35) with opposite open ends (36); first stabilizing means (60, 61) movable to and from an operating position to close the tubular wrapping (35) by means of a longitudinal joint; third wrapping means (84) for folding said open ends (36) on to the product (2); and second stabilizing means (85) for fixing said folded ends (36) by means of an end joint; the machine (1) being characterized in that said conveying means (3, 13, 14, 15) comprise a gripping device (43) movable with the conveying means (3, 13, 14, 15) along said path (P), and also movable, in relation to the conveying means (3, 13, 14, 15), to and from a gripping position contacting, in use, end surfaces (42) of the product (2) parallel to said traveling direction (8); and control means (45) for maintaining the gripping device (43) in the gripping position for at least one interval of time in which said first stabilizing means (60, 61) are in the operating position.

2. A machine as claimed in claim 1, characterized in that said control means (45) are so formed as to maintain the gripping device (43) in the gripping position to feed the product (2) along said path (P) for at least a further interval of time in which said second wrapping means (91, 92; 103, 104) are in said engaged position.

3. A machine as claimed in claim 2, characterized in that said control means (45) are so formed as to maintain the gripping device (43) in the gripping position to feed the product (2) along a portion of said path (P) extending at least from said intercepting station (31).

4. A machine as claimed in claim 1, characterized in that said gripping device (43) comprises a pair of coaxial pads (41) fitted to said conveying means (13, 14, 15) and connected to the conveying means (13, 14, 15) in sliding manner; said control means (45) comprising a cam actuating device (45) for moving the pads (41) in opposite directions, and crosswise to said traveling direction (8), to and from said gripping position.

5. A machine as claimed in claim 4, characterized in that each said pad (41) comprises a hollow body (52) insertable inside a respective said open end (36) of the tubular wrapping (35); the hollow body (52) comprising external suction holes (53).

6. A machine as claimed in claim 1, characterized in that said sheet (33) is made of dielectric material; said first wrapping means (87, 89) comprising first generating means (89) for generating an electric field.

7. A machine as claimed in claim 6, characterized in that said first wrapping means (87, 89) comprise two folding elements (87) located along said path (P), on either side of the (P), and immediately downstream from said intercepting station (31) to define a passage for the product (2) and respective sheet (33); said first generating means (89) being so located as to generate an electric field at said passage.

8. A machine as claimed in claim 1, characterized in that said second wrapping means (91, 92; 103, 104) comprise a first (92; 103) and a second (91; 104) folding device movable in relation to said conveying means (3, 13, 14, 15) to engage, in use, respective end portions (99, 100) of said sheet (33) projecting from the respective product (2) in a direction opposite to said traveling direction (8), and to fold the end portions (99, 100) squarely one on top of the other.

9. A machine as claimed in claim 8, characterized in that said sheet (33) is made of dielectric material; at least one of said folding devices (91, 92) comprising second generating means (98) for generating an electric field.

10. A machine as claimed in claim 8, characterized in that said second wrapping means (103, 104) are so located as to cooperate with said first stabilizing means (60, 61) to maintain, in use, said two end portions (99, 100) superimposed when the first stabilizing means (60, 61) move into the operating position.

11. A machine as claimed in claim 1, characterized in that said first stabilizing means (60, 61) comprise a stabilizing pressure element (60) and a counter-pressure element (61), both movable in relation to the conveying means (3, 13, 14, 15) to cooperate respectively with a first (101) and an opposite second (12) surface of the product (2); said second surface (12) being said lateral surface (12) of the product (2).

12. A machine as claimed in claim 11, characterized in that said sheet (33) of wrapping material is made of thermoplastic material; said pressure element (60) being a heat-sealer.

13. A machine as claimed in claim 11, characterized by comprising transverse retaining means (67, 68) associated with said first stabilizing means (60, 61) to compress the product (2) in a direction crosswise to said traveling direction (8) when the first stabilizing means (60, 61) are in the operating position.

14. A machine as claimed in claim 1, characterized in that said sheets (33) of wrapping material are made of thermoplastic material; said stabilizing means (60, 61, 85) comprising respective heat-sealing means (60, 85).

* * * * *